US008113351B2

(12) United States Patent
Durço

(10) Patent No.: US 8,113,351 B2
(45) Date of Patent: Feb. 14, 2012

(54) BOX AND PALLET ASSEMBLY

(75) Inventor: José Roberto Durço, São Paulo SP (BR)

(73) Assignee: Pack Less Desenvolvimento e Inovacao Ltda. (BR)

( * ) Notice: Subject to any disclaimer, the term of this patent is extended or adjusted under 35 U.S.C. 154(b) by 0 days.

(21) Appl. No.: 12/615,347

(22) Filed: Nov. 10, 2009

(65) Prior Publication Data

US 2011/0108445 A1 May 12, 2011

(51) Int. Cl.
*B65D 19/06* (2006.01)
*B65D 19/44* (2006.01)

(52) U.S. Cl. ..... 206/600; 108/55.1

(58) Field of Classification Search ..... 206/386, 206/595–600; 108/51.11, 55.1, 55.3–56.3
See application file for complete search history.

(56) References Cited

U.S. PATENT DOCUMENTS

| | | | | | |
|---|---|---|---|---|---|
| 2,544,657 | A | * | 3/1951 | Cushman | 206/598 |
| 2,774,490 | A | | 12/1956 | Strong | |
| 3,036,802 | A | * | 5/1962 | Kitchell | 206/598 |
| 3,112,715 | A | | 12/1963 | Callahan et al. | |
| 3,797,727 | A | * | 3/1974 | Downing et al. | 206/600 |
| 4,296,860 | A | * | 10/1981 | Hsu et al. | 206/386 |
| 4,445,614 | A | * | 5/1984 | Mitsumori et al. | 206/599 |
| 4,765,252 | A | * | 8/1988 | Shuert | 108/55.1 |
| 4,785,957 | A | * | 11/1988 | Beck et al. | 206/600 |
| 4,936,451 | A | * | 6/1990 | Shuert | 206/386 |
| 4,980,214 | A | | 12/1990 | Charriere | |
| 5,067,418 | A | | 11/1991 | Carter | |
| 5,465,672 | A | | 11/1995 | Boyse et al. | |
| 5,597,084 | A | * | 1/1997 | Parasin | 206/600 |
| 5,890,437 | A | | 4/1999 | Hill | |
| 6,234,087 | B1 | * | 5/2001 | Brown | 108/55.1 |
| 6,533,121 | B1 | | 3/2003 | Ross | |
| 6,745,703 | B2 | * | 6/2004 | Torrey et al. | 108/51.11 |
| 6,758,148 | B2 | * | 7/2004 | Torrey et al. | 108/51.11 |
| 7,128,209 | B2 | * | 10/2006 | Bringard et al. | 206/386 |
| 7,516,706 | B2 | | 4/2009 | Creighton et al. | |
| 7,913,630 | B2 | | 3/2011 | Creighton et al. | |
| 2006/0254473 | A1 | | 11/2006 | Creighton et al. | |

FOREIGN PATENT DOCUMENTS

BR PI 0700676-4 A 10/2008

OTHER PUBLICATIONS

International Search Report and Written Opinion for International Application No. PCT/BR2008/000053; date of mailing Jun. 24, 2008.

Office Action dated Aug. 19, 2011, U.S. Appl. No. 12/551,968, filed Sep. 1, 2009.

* cited by examiner

*Primary Examiner* — Bryon Gehman
(74) *Attorney, Agent, or Firm* — Alston & Bird LLP

(57) ABSTRACT

The present invention relates to an assembly formed by a box and a pallet for storage and transport of varied loads. The assembly optimizes the use of the available space, thereby keeping the assembly stable and safe throughout the transport process. The box enables the placement of loads while the pallet supports both the box and the loads. In this assembly, the box includes a lower portion that is arranged on the pallet, preferably in a removable manner. The box includes at least one fitting opening and the pallet includes at least one fitting portion configured to cooperatively associate with the fitting opening of the box.

14 Claims, 4 Drawing Sheets

BOX AND PALLET ASSEMBLY

BACKGROUND

1. Field of the Invention

The present invention relates to an assembly formed by a box and a pallet for storage and/or transport of varied loads, capable of optimizing the use of useful space available thereto, thus keeping their stability and safety.

2. Description of Related Art

Pallets are structures normally used for temporary storage and/or transport of varied loads by means of forklifts trucks. In general, pallets are made of wood or plastic, and have a constructive arrangement, which, in certain situations, do not meet the functionalities and the desired requirements.

In view of these disadvantages, Brazilian patent application BR PI 0700676-4 discloses a pallet comprising dome shaped support elements associated with each other by means of a fabric, such as, for instance, raffia. These support elements consist of a light, flexible and compression-resistant material, such as, for instance, alveolar plastic. This innovative arrangement enabled a significant improvement in the static and dynamic stability provided by the pallet to the loads arranged thereon, and conferred high durability and reduced manufacturing costs.

This static stability is an important feature, especially when loads are stacked on the pallet. The constructive arrangement of the pallet disclosed in BR PI 0700676-4 enables that a maximum amount of loads is stacked without sliding, thereby offering stability and safety. With regard to dynamic stability, this pallet is capable of perfectly stabilizing on the forks of the forklifts trucks, thus avoiding sliding and slipping, and preventing any risks of damage to the load when pallets are moved on forklifts trucks. The design of the pallet has also taken into account other types of movement to which it is submitted during a production process, for instance, its transportation through a conveyor belt which moves horizontally and vertically.

Despite the advantages and benefits described above, it was verified that the very dimensions of the pallet limits its storage and transport capacity, resulting in the low utilization of the available space, especially when intending to store or transport high loads or in large quantities. In this type of situation, there is a need for relatively high availability of useful space (volume), that is, a volume that is sufficient for housing these types of loads without affecting their safety and stability (preventing them from falling/collapsing or spreading), which make it difficult to transport certain types of products, especially bulk products in large volumes.

Normally, a pallet having greater storage capacity requires a larger base area, which is obviously undesirable. On the other hand, if the base area of the pallet is reduced to occupy less space, its storage capacity is compromised, because, the smaller the area, the lower the total useful volume for the safe placement of load without having to resort to stacking.

Considering said restraints, studies, analyzes and tests were carried out proving that the storage and/or transport of high loads and/or in large quantities is possible without significantly modifying the structure and dimensions of the pallet originally disclosed in BR PI 0700676-4 or of any common and already known pallet.

Therefore, a possibility of improving the usability of such pallets was identified so as to make better use of their characteristics thereby maximizing all its usage potential and broaden its field of application.

OBJECT OF THE INVENTION

The object of the present invention is to provide a mounting arrangement comprising a pallet, which is of low cost and capable of enabling the storage and/or transport of varied loads, including high loads and/or loads stacked in large quantities, or the transport of bulk goods, so as to optimize the useful space (volume) available thereto without compromising safety and stability.

BRIEF SUMMARY OF THE INVENTION

The object of the present invention is achieved by the provision of a box and pallet assembly, wherein the box is capable of enabling the placement of the loads and the pallet is capable of supporting the box and said loads. In this assembly, the box is associatedly arranged on the pallet by means of its lower portion.

BRIEF DESCRIPTION OF THE DRAWINGS

The present invention will be described in more detail below, with reference to the attached drawings, in which.

DETAILED DESCRIPTION OF THE DRAWINGS

Figure 1:
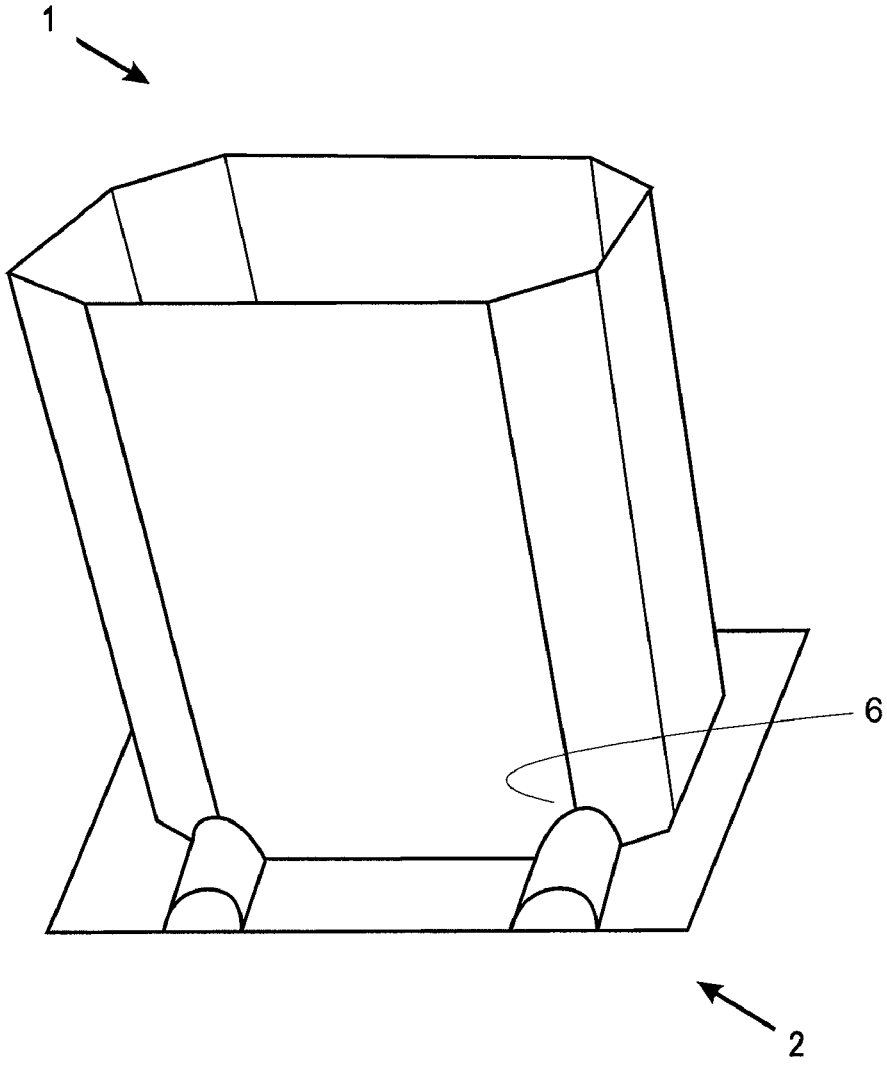
FIG. 1—represents a first schematic perspective view of a box and pallet assembly, which is the subject matter of the present invention.

FIG. 1 illustrates a schematic perspective view of the box 1 and pallet 2 assembly according to a preferred embodiment of the present invention, for use in the storage and/or transport of varied loads.

Figure 2:
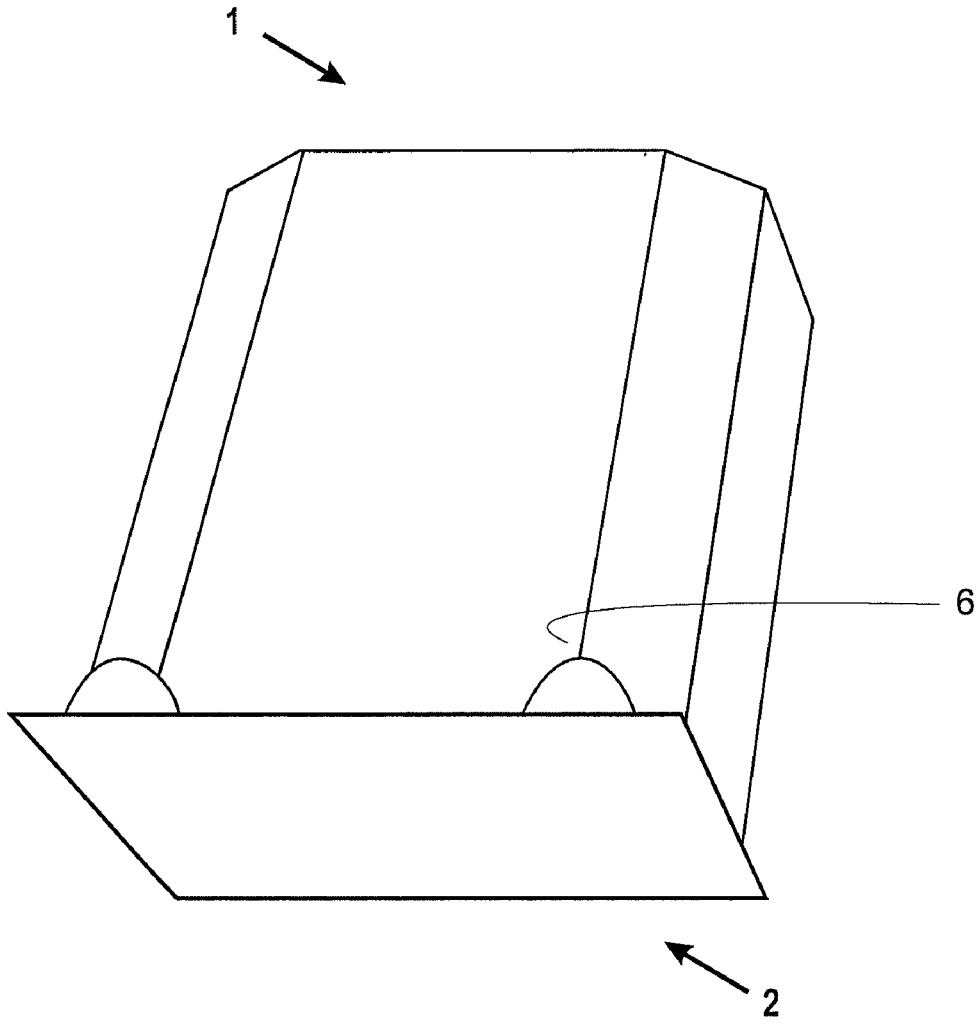
FIG. 2—represents a second schematic perspective view of the box and pallet assembly illustrated in FIG. 1.

As can be observed in FIGS. 1 and 2, the box 1, capable of enabling the placement of loads in it, has a lower portion 6 associated with the pallet 2. Thus, the box 1 is arranged on the pallet 2, the function of which is to support the box 1 and loads.

It should be noted that, although a first embodiment (illustrated by the drawings) of the assembly of the invention comprises a pallet as defined in BR PI 0700676-4, it is evident that it can be replaced with any other type of pallet taking advantage of the increased load capacity without the risk of collapsing and the capacity to transport bulk goods at a higher or lower extent.

Preferably, the lower portion 6 of the box 1 is removably associated with the pallet 2 by means of an interference fit, although it is evident that the box 1 can simply rest on it. Optionally, box 1 can be fixedly associated with pallet 2 by means of glue, for instance, or any other means.

Figure 3:
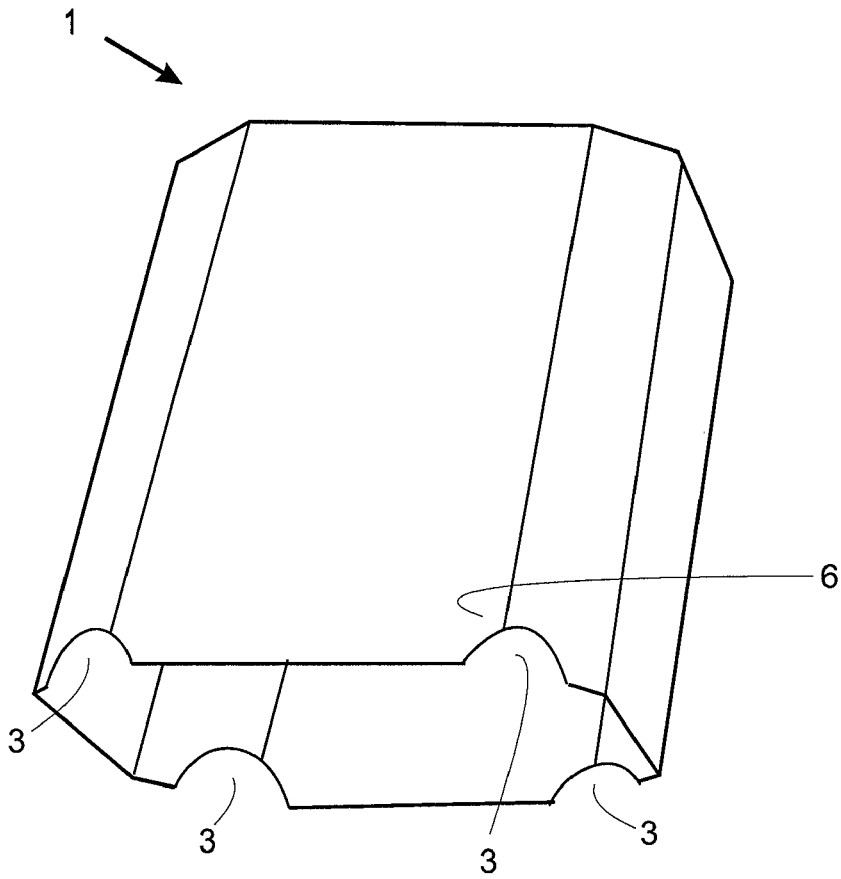
FIG. 3—represents a schematic perspective view of the box from the box and pallet assembly illustrated in FIG. 1.
Figure 4:
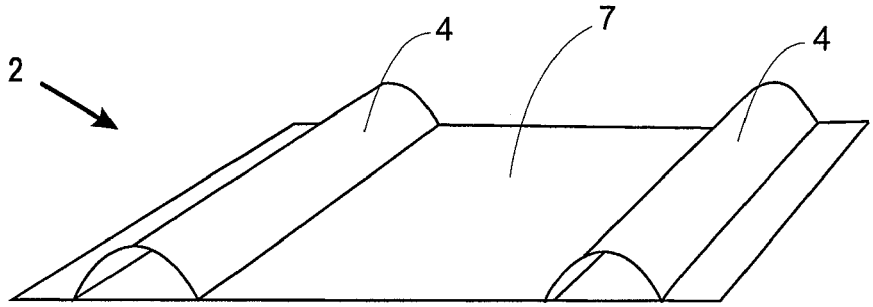
FIG. 4—represents a schematic perspective view of the pallet from the box and pallet assembly illustrated in FIG. 1.

As shown in FIG. 3, the lower portion 6 of the box 1 has at least one fitting opening 3 and, as shown in FIG. 4, the pallet 2 has at least one fitting portion 4 having a dome-shaped cross-section which is capable of cooperatively associating with the fitting opening 3. Preferably, the pallet 2 comprises a plurality of fitting portions 4. Particularly, in the preferred embodiment of the present invention, the pallet 2 has two fitting portions 4.

Preferably also, the lower portion 6 of the box 1 has a plurality of fitting openings 3. Particularly, in the preferred embodiment of the present invention, the box 1 has four fitting openings 3 aligned in pairs, which can be easily observed specially in FIGS. 3 and 4.

The fitting portions 4 are associated with each other by means of a support base 7 on the pallet 2. Said support base 7 has a coating fabric which preferably comprises raffia. Raffia is a low-cost product and is produced by transformed synthetic fibers of polypropylene. High mechanical strength, dimensional stability (easy molding), easy cleaning and high thermal stability are its main characteristics, and it provides sufficient friction to stabilize the load placed on the pallet 2 without sliding. Another type of fabric (natural, synthetic or artificial) can be used, provided its characteristics do not affect the functionality and the safety requirements met by the use of raffia.

The fitting portion 4, in turn, comprises a plastic of alveolar structure, such as for instance, the product commercially called Polionda®. Said alveolar structure is arranged in double layers and is capable of supporting weights and movements of several types of loads. Polionda® is a thermoplastic product and comprises other characteristics such as high thermal resistance and impermeability. In this case, another type of material can also be used, provided the functionality and the safety requirements promoted by the alveolar plastic are maintained. Alveolar plastic can also be used together with any other type of material such as cardboard or some other kind of plastic.

Therefore, the dome-shaped configuration together with the alveolar plastic has high mechanical strength and, consequently, a good total allowable load. In addition, the fitting portions 4 are configured so as to enable a stable contact with the forks of the forklifts trucks, without the sliding of the pallet 2 when said forks are inserted and when loads are moved and transported by the forklifts trucks. Thus, good dynamic stability is obtained. Furthermore, the fitting portions 4 also work as guides for the forks of the forklifts trucks facilitating transport operation by the operator.

Still in a preferred aspect, the bottom of the box 1 is partially or totally open so that the pallet 2 itself is part of the bottom of the assembly. Alternatively, the box 1 can have a one-piece bottom (without openings), provided there is no harm to the association of the fitting openings 3 of box 1 with the fitting portions 4. The specific configuration of the bottom may vary according to the convenience and utilization needs, and is irrelevant for defining the scope of protection of the present invention. The height of box 1 used may vary according to the need of use, as demanded by the dimensions and/or volume of the load to be stored and/or transported thereby.

Figure 5:
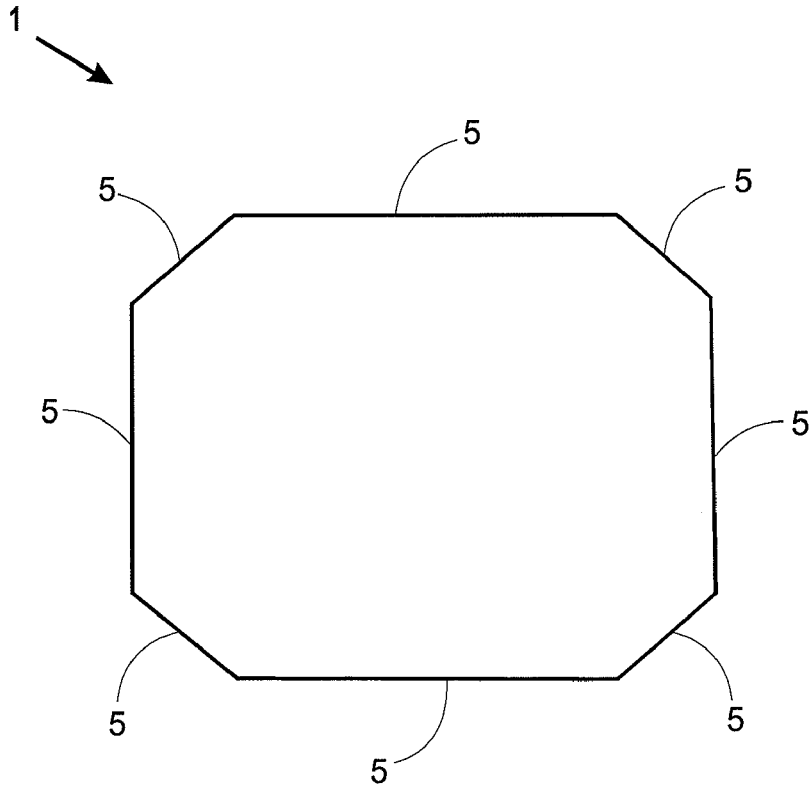
FIG. 5—represents an upper schematic view of the box from the box and pallet assembly illustrated in FIG. 1.
Figure 6:
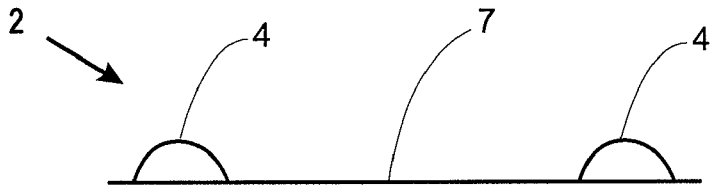
FIG. 6—represents a side schematic view of the pallet from the box and pallet assembly illustrated in FIG. 1.

The box 1 further comprises side walls 5 associated with each other, so as to form a structure, which is preferably self-bearing, with a regular geometric shape, and having its upper view as reference. Particularly, the box 1 has a regular octagonal geometric shape, as can be seen in FIG. 5. Evidently, the box 1 can have other regular geometric shapes (square, rectangular, hexagonal, etc.) or irregular geometric shapes provided they are suitable for this application.

With regard to the material used, the box 1 preferably consists of one or more cellulose compounds, although other types of materials can be used, such as, varied polymeric compounds, depending on the specific application desired. However, cellulose material has low cost and is easily recyclable, which represents a great advantage in comparison with other types of material.

Therefore, there is optimum use of the space (volume) available, enabling the stacking of load without the risk of collapsing, which renders the assembly of the present invention particularly fit to transport bulk goods of small size (granulated, for instance).

The first embodiment of the box and pallet assembly described above provides a mounting arrangement that brings together the qualities of the pallet disclosed in brazilian patent document BR PI 0700676-4, such as stability and safety, and the high storage capacity of the boxes, optimizing the use of the space (volume) available. Furthermore, the materials used are of low cost and recyclable, thereby contributing to sustainable development. Finally, the assembly has a simple mounting system, which enables a fast and easy implementation in a production line.

It should be noted that, although the assembly of the present invention preferably comprises a pallet having a structure similar to the one disclosed in BR PI 0700676-4, alternatively other types and constructive arrangements of pallets can be used, provided they are configured to enable a safe and stable association with the box 1.

The examples described above represent preferred embodiments; however, it should be understood that the scope of the present invention encompasses other possible variations, and is limited only by the content of the appended claims, which include all possible equivalents.

That which is claimed is:

1. A box and pallet assembly, wherein the box is capable of enabling the placement of loads, the pallet being capable of supporting the box and loads, the assembly being characterized in that the box comprises a lower portion associated with the pallet, the lower portion including at least one fitting opening having a dome-shaped cross-section; and the pallet comprises at least one fitting portion configured to form at least one frictional interference fit with the at least one fitting opening of the box, the at least one frictional interference fit interlocking and retaining the at least one fitting portion relative to the at least one fitting opening.

2. The assembly according to claim 1, wherein the lower portion of the box is removably associated with the pallet.

3. The assembly according to claim 1, wherein the lower portion of the box has a plurality of fitting openings.

4. The assembly according to claim 1, wherein the box has a partially or totally open bottom.

5. The assembly according to claim 1, wherein the box comprises side walls associated with each other, the side walls forming a structure having a regular geometric shape.

6. The assembly according to claim 5, wherein the regular geometric shape structure is octagonal.

7. The assembly according to claim 1, wherein the fitting portion has a dome-shaped cross-section.

8. The assembly according to claim 1, wherein the fitting portion comprises a plastic of alveolar structure.

9. The assembly according to claim 1, wherein the pallet comprises a plurality of fitting portions.

10. The assembly according to claim 9, wherein the pallet comprises a support base having a coating fabric, the support base defining a position of each of the fitting portions relative to one another.

11. The assembly according to claim 10, wherein the coating fabric comprises raffia.

12. The assembly according to claim 1, wherein the box is provided of cellulose material.

13. The assembly according to claim 1, wherein the box further comprises a bottom associated with the pallet.

14. The assembly according to claim 13, wherein the bottom is a one-piece bottom.

* * * * *